US005224846A

United States Patent [19]

Kirschner et al.

[11] Patent Number: 5,224,846

[45] Date of Patent: Jul. 6, 1993

[54] FUEL INJECTION PUMP FOR INTERNAL COMBUSTION ENGINES

[75] Inventors: Juergen Kirschner, Wimsheim; Uwe Kuhn, Riederich; Norbert Kaiser, Nürnberg, all of Fed. Rep. of Germany

[73] Assignee: Robert Bosch GmbH, Stuttgart, Fed. Rep. of Germany

[21] Appl. No.: 916,738

[22] Filed: Jul. 22, 1992

[30] Foreign Application Priority Data

Aug. 16, 1991 [DE] Fed. Rep. of Germany ..... 4127032

[51] Int. Cl.[5] ..... F04B 7/04

[52] U.S. Cl. ..... 417/499; 417/500; 123/501; 123/503

[58] Field of Search ..... 417/490, 494, 499, 500; 123/495, 500, 501, 503

[56] References Cited

U.S. PATENT DOCUMENTS

| | | | |
|---|---|---|---|
| 4,737,086 | 4/1988 | Yamaguchi et al. | 417/499 |
| 4,770,149 | 9/1988 | Kramer et al. | 123/495 |
| 5,080,564 | 1/1992 | Kasahara et al. | 417/494 |

*Primary Examiner*—Richard A. Bertsch
*Assistant Examiner*—Charles G. Freay
*Attorney, Agent, or Firm*—Edwin E. Greigg; Ronald E. Greigg

[57] ABSTRACT

A fuel injection pump for internal combustion engines, having a reciprocating pump piston that is guided in a cylinder liner, having a control slide that is axially displaceable on the pump piston, inside a lateral recess of the cylinder liner, and is moved via an adjusting shaft that is located in a transverse conduit disposed in a pump housing transversely to the cylinder axis. The transverse conduit intersects the housing bore that receives the cylinder liner in the region of a recess that form a partial suction chamber, forming a through opening for a lever of the control slide, and it also serves to drain fluid from the partial suction chamber. For hydraulic reasons, this through opening is embodied according to the invention by means of machining from the housing bore in tub-like fashion, and the control slide is also flattened, adapting to the enlargement, so that the high kinetic energy of the fuel stream emerging from the diversion bore and of the fuel flowing out to the transverse bore can be rapidly lowered.

3 Claims, 2 Drawing Sheets

FIG. 5
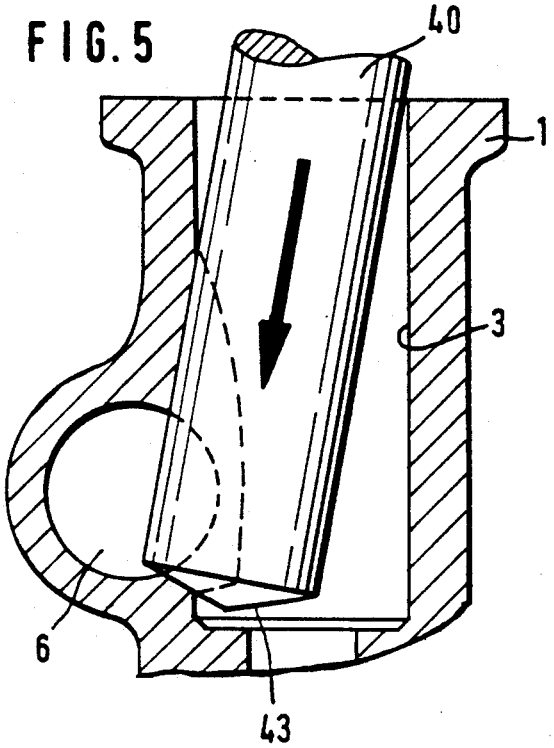
FIG. 4
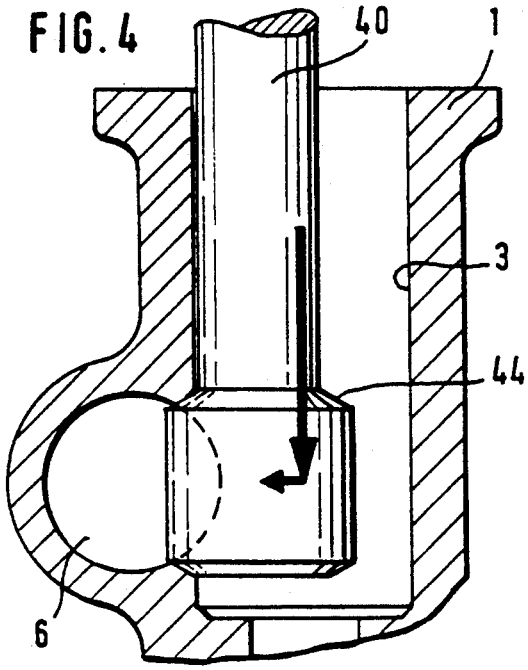
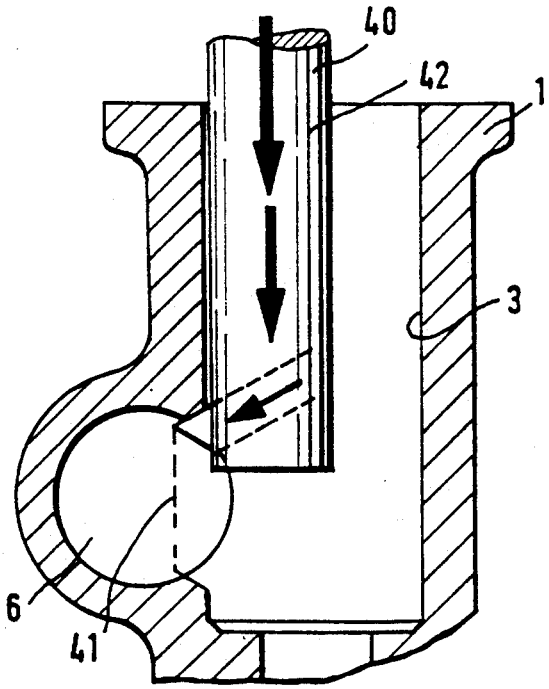
FIG. 6

FUEL INJECTION PUMP FOR INTERNAL COMBUSTION ENGINES

BACKGROUND OF THE INVENTION

The invention is based on a fuel injection pump for internal combustion engines A fuel injection pump of this kind is already known from U.S. Pat. No. 4,737,086. In slide-controlled fuel injection pumps of this kind, the injection quantity and/or onset are determined by the axial location of the control slide. In an in-line pump arrangement, a plurality of such control slides are adjusted in a known manner via a common adjusting shaft, on which there is one transmission element (lever) per pump element. This shaft is located in a conduit extending transversely to the pump axis, and it is rotatably supported on both its ends toward the housing. In order for the transmission element on the adjusting shaft to be capable of engaging a groove of the control slide, a through opening from the transverse conduit to the receiving bore of the pump element comprising the pump piston and pump cylinder must be provided on each engine cylinder. At the same time, this opening also serves to carry fuel between the various pump elements and the transverse conduit, which thus acts as a collective return conduit. The supply onset is regulated via the closure of the filling and relief conduit of the pump piston, by means of the position of the lower edge of the control slide. The end of high-pressure injection (which in terms of time is on the one hand the end of injection and on the other an injection-quantity-determining end of the high-pressure pumping) is defined when the mouth of the filling and relief conduit on the pump piston is uncovered by the control slide, thereby diverting the fuel, which is at very high pressure, from the pump work chamber into the recess of the cylinder liner, via the relief conduit. The diverted fuel stream has very high kinetic energy, which puts a heavy strain on the materials struck by the stream. In the known fuel injection pump of this type, a radial diversion bore is disposed in the control slide; it is opened by an oblique control edge, disposed on the pump piston in the form of a control opening, after the effective injection stroke has been executed. When it is opened, the diversion stream passing through the diversion bore first strikes the wall of the recess of the cylinder liner, where it is reflected, and from there it flows out with high kinetic energy into the aforementioned collective return conduit of the control slide adjusting shaft. This kind of outflow has the disadvantage that the deflected stream, which still has very high kinetic energy, strikes the wall of the suction chamber and flows at high speed past the edges into the collective return conduit. In this process the stream acts upon the fuel housing, which comprises softer material than that of the pump cylinder liner and control slide, which are of tempered steel. The consequence is cavitation and erosion damage on the suction chamber wall of the pump housing and on the edges of the pump housing around which the fuel flows. This damage occurs above all at the transition between the recess and the transverse conduit, because for structural reasons there is only a relatively small transitional cross section, formed from the intersection of the two bores, between the two, with accordingly sharp edges.

OBJECT AND SUMMARY OF THE INVENTION

The fuel injection pump according to the invention has the advantage over the prior art that while avoiding the above disadvantages, a larger cross section within the same pump dimensions is furnished. By way of this cross section, the fuel emerging at the pump piston can flow out between the recess and the control slide with the least possible hindrance; housing wall parts with sharp-edged protrusions that are threatened by cavitation damage are avoided. Adapting the shape of the control slide to the machined housing shape makes an optimal overall cross-sectional design of the through conduit possible. In addition, the improved fuel outflow makes for a more favorable temperature distribution in the fuel injection pump, because the fuel, which is heated strongly by the compression, can be drained out better. Machining the housing from the inside means that a machining opening, and the associated cross-sectional weakening and the sealing effort and expense that it would entail, can be dispensed with.

The invention will be better understood and further objects and advantages thereof will become more apparent from the ensuing detailed description of a preferred embodiment taken in conjunction with the drawings.

BRIEF DESCRIPTION OF THE DRAWINGS

FIGS. 4–6 are basic sketches of the machining, using a tool introduced into the element bore.

DESCRIPTION OF THE PREFERRED EMBODIMENT

Figure 1:
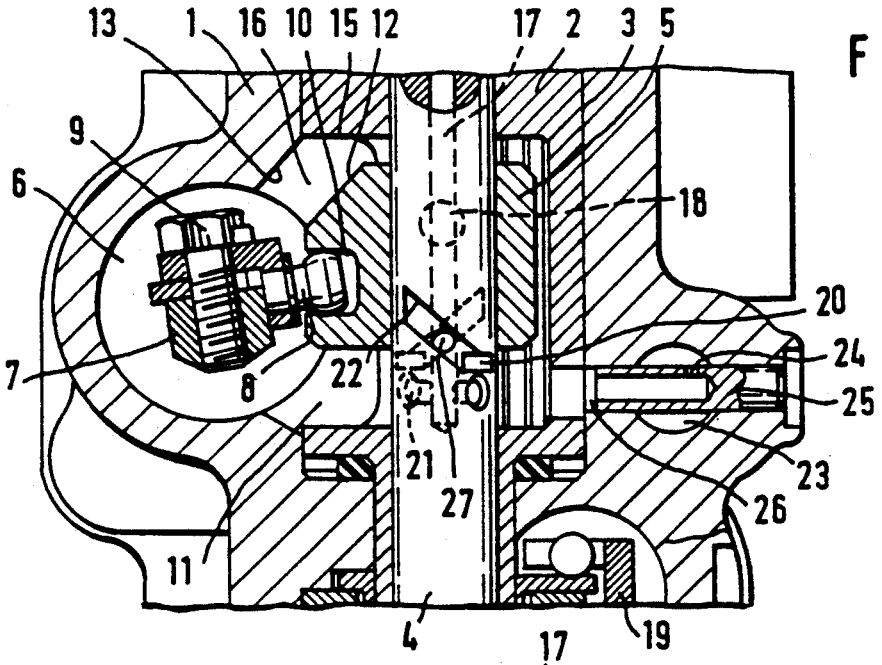
FIG. 1 is a fragmentary longitudinal section through a fuel injection pump according to the invention, with the control slide on the pump piston shown in its upper location.

In a pump housing 1, shown in fragmentary form in FIG. 1, of a fuel injection pump, a cylinder liner 2 is inserted into a longitudinal bore 3 in which a pump piston 4 is moved back and forth by a drive means, not shown. The cylinder liner 2 has a recess, embodied as a blind bore that forms a partial suction chamber 11, and arranged such that the recess receives a control slide 5 that is axially displaceable on the pump piston 4 penetrating the partial suction chamber 11. The axial actuation of the control slide is effected via an adjusting shaft 7, disposed in a transverse conduit 6 that is located transversely to the axis of the longitudinal bore 3 in the pump housing 1, thereby intersecting the longitudinal bore in the region of the partial suction chamber 11, forming a through opening 16; a lever 8 can be firmly clamped onto this adjusting shaft 7 with a screw 9 and is thus disposed adjustably in terms of its rotary location; the other end of the lever 8 reaches through the through opening 16 into a groove 10 of the control slide 5. On its end remote from the drive means, the pump piston 4 forms a pump work chamber, not shown here, in the cylinder liner 2. To supply this chamber with fuel, the pump piston 4 has an axial bore 17, which begins at the pump work chamber and discharges into a transverse bore 21 and connects the pump work chamber to the partial suction chamber 11. Fuel delivery to the partial suction chamber 11 is effected via an inflow conduit 23 in the pump housing 1, a throttle insert 25 is located in the inflow and provided with a throttle bore 24, and a connecting conduit 26 branching off from the throttle insert and discharging into the partial suction chamber 11. Two oblique grooves are also disposed in the jacket face of the pump piston 4, which form two control edges 22 and adjoining each of them a respective recess 20, which as control openings are disposed in pairs, diametrically opposite one another, on the pump piston 4 and communicate with one another via a transverse bore 27, which likewise discharges into the axial bore 17. The location of the control edge 22 can be varied by rotating the pump piston 4, in that a governor rod 19 rotates the pump piston via a governor sleeve, not shown in detail. The control openings, having the control edges 22 and the recesses 20, cooperate with two radial bores in the control slide 5 acting as diversion bores 18; the edges of these diversion bores 18 serve as control edges, and their mouths are oriented toward the side walls of the partial suction chamber 11, approximately parallel to the transverse conduit 6.

In a fuel injection pump of this type, a plurality of pump elements 2, 4 with control slides 5 are preferably disposed in line in the pump housing 1 and are then actuated by the common adjusting shaft 7; the coupling elements in the form of levers 8 correspond in number to the number of pump elements 2, 4. The adjusting shaft 7, as already noted, is located in the transverse conduit 6 in the pump housing 1 and is rotatably supported on both its ends toward the housing. The through opening 16 from the transverse conduit 6 to the longitudinal bore 3 of the pump element 2, 4 is necessary in each cylinder liner 2, in order that the lever 8 on the adjusting shaft 7 can engage the groove 10 of the control slide 5. This through opening 16 also serves to carry the fuel out of the partial suction chamber 11 into the transverse conduit 6, which also acts as a collective return conduit.

In known fuel injection pumps, this through opening 16 is embodied such that a defined opening size is created from the intersection of the two bores 3, 6, as a result of the geometric relationship between the transverse conduit 6 and the pump element axis; for structural reasons, this size cannot exceed certain limit values. To enable a favorable return flow of fuel, the through opening 16 is therefore widened into a tub-like shape. The interior of the pump housing 1, at the through opening 16 to the transverse conduit 6, accordingly has a chamfer 13 of the housing that begins at the boundaries 15 of the partial suction chamber 11 toward the pump work chamber and decreases toward the transverse conduit 6; the chamfer is formed by removal of the flow-hindering edges on the pump housing 1. In addition, the control slide 5, on the side toward the pump work chamber and transverse conduit 6, has a chamfer 12, which is located in the region of the plane of symmetry of the partial suction chamber 11 through the pump piston axis. If the fuel injection pump has a small structural size and the partial suction chamber 11 has a short axial length, this chamfer 12, whose slope is dictated by production considerations, results in a hydraulically favorable large cross section of the through opening 16.

Given the above-described structural design, machining of the pump housing 1 can be done in a simple manner from the longitudinal bore 3 of the pump element 2, 4.

Some options for machining are shown in FIGS. 4–6. In FIG. 4, the tool 40, a solid cylindrical milling cutter with a size corresponding to the tube-like milled recess, is introduced axially, with conical flanks 44, into the longitudinal bore 3 and is thrust radially against the edges of the housing 1 at the transverse conduit 6 at the level of the transverse conduit 6. In FIG. 5, the tool 40 is an end milling cutter; to produce the milled recess, it is introduced offset from the pump element axis and tilted with respect to it. Its conical tip 43 then forms the conduit side walls. In the case of the tool of FIG. 6 as well, machining requires only an axial feed of the tool 40. To this end, the tool 40 is driven into the longitudinal bore 3, and at the level of the transverse conduit 6, an adjustable conical blade 41 is extended from the main spindle 42 of the tool 40.

Figure 2:
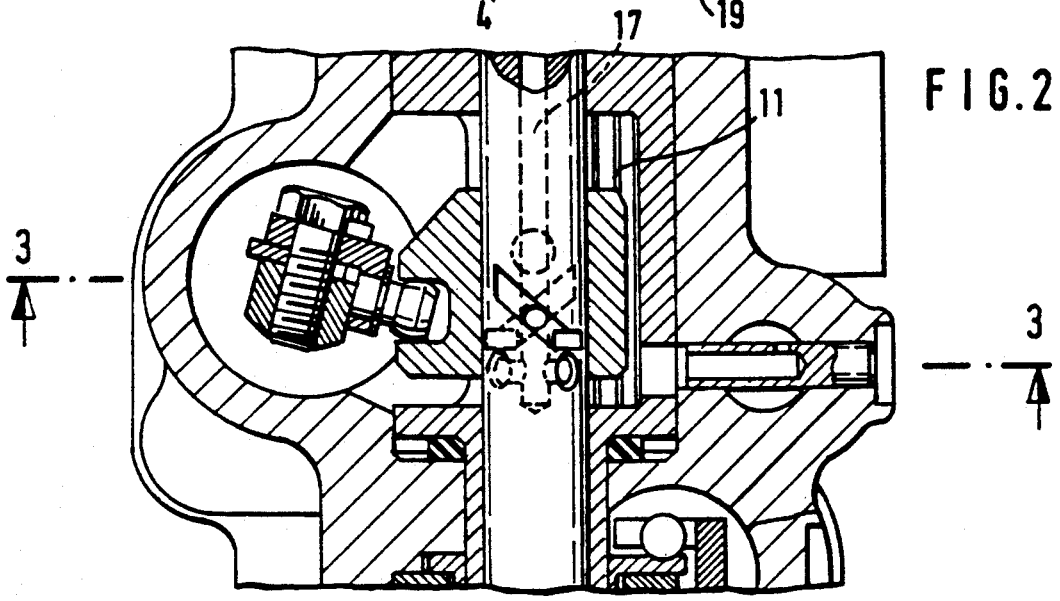
FIG. 2 shows the exemplary embodiment of FIG. 1, with the control slide in its lower location.
Figure 3:
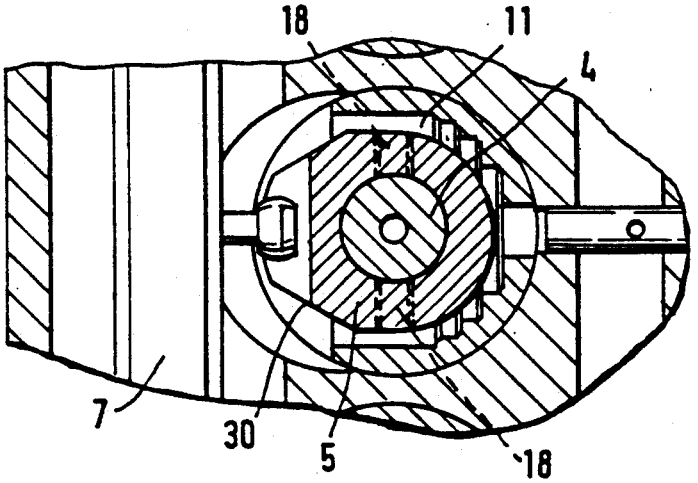
FIG. 3 is a cross section through the part of the fuel injection pump of FIG. 2 embodied according to the invention.

FIGS. 2 and 3 show the subject of the invention, with a structure analogous to that described for FIG. 1; FIG. 2 shows the control slide 5 in a lower location, and FIG. 3 is a cross section through FIG. 2, in which two lateral chamfers 30 are disposed on the control slide 5, on the side toward the adjusting shaft 7 in the radial plane of the pump piston 4; as a result of these chamfers, the control slide tapers toward the adjusting shaft 7.

The exemplary embodiment shown functions as follows:

In the location of the pump piston 4 and control slide 5 shown in FIG. 1, the pump work chamber is filled with fuel via the transverse bores 21, which are open to the partial suction chamber 11, the axial bore 17, and the recesses 20 of the control grooves that discharge into the transverse bore 27 protruding into the axial bore 17. In the supply stroke of the pump piston 4, some of the fuel is first positively displaced out of the pump work chamber back into the partial suction chamber 11, via the axial bore 17 and the transverse bore 21, until the control edges 22, recesses 20 and transverse bores 21, 27 are covered by the control slide 5. From that supply stroke position on, the high pressure can develop in the pump work chamber, and the injection to the engine can begin. This injection is terminated once the control edges 22 come to coincide with the diversion bore 18 of the control slide 5. The fuel, which is at very high pressure, is then diverted from the pump work chamber, via the axial bore 17 and the diversion bore 18, into the partial suction chamber 11, where it strikes the wall of that chamber with high kinetic energy. The enlargement of the cross section of the through opening 16 has an advantageous effect now, because the fuel, which is at high pressure and high temperature, can now flow out rapidly into the transverse conduit 6 via the enlarged cross section, without encountering flow hindrances. The consequences are a rapid drop in the local temperature in the partial suction chamber 11, only slight effects of cavitation upon the nontempered pump housing walls, and hence less wear of material, which favors a longer service life of the entire fuel injection pump.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, having a cylinder liner (2), disposed in a longitudinal bore (3) of a pump housing (1), a reciprocating pump piston (4) which defines a pump work chamber, in which a high-pressure fuel pumping is controlled, a filling and relief conduit, (17, 20, 21) of the pump piston (4) which discharges at a circumference of the pump piston, a control slide (5) that cooperates with the filling and relief conduit, said control slide is axially adjustable on the pump piston (4), and is located inside a lateral, substantially cylindrical recess in the cylinder liner (2) that forms a partial suction chamber (11), the control slide (5) being moved by an adjusting shaft (7), said adjusting shaft is disposed in a transverse conduit (6) in the pump housing (1) that extends transversely to the longitudinal bore (3) and intersects the longitudinal bore, forming a lateral through opening (16), the control slide movement taking place via a lever (8) that protrudes through the lateral opening (16) into the cylinder liner (2) in the region of the partial suction chamber (11), a diameter of the transverse conduit (6) is smaller than an axial length of the partial suction chamber (11), and a tub-like cross-sectional transition is formed between the longitudinal bore (3) and the transverse conduit (6), and on the control slide (5), a chamfer (12) toward the pump work chamber is provided, a slope of the chamfer (12) preferably corresponds to an oblique course, rising toward the longitudinal bore (30, toward the pump work chamber, of the cross-sectional transition of the lateral through opening (16).

2. A fuel injection pump as defined by claim 1, in which the control slide (5) tapers via lateral chamfers (30) in a radial plane of the pump piston (4) on a side toward the adjusting shaft (7).

3. A fuel injection pump as defined by claim 1, in which the cross-sectional transition at the lateral through opening (16) between the longitudinal bore (3) and the transverse conduit (6) is produced by a solid cylindrical milling cutter with conical flanks (44), which is introduced into the pump housing (1) via the bore (3).

* * * * *